US012523036B2

(12) United States Patent
Garber

(10) Patent No.: US 12,523,036 B2
(45) Date of Patent: Jan. 13, 2026

(54) WIDE SLAB CONCRETE FLOOR WITH REDUCED CARBON FOOTPRINT AND METHOD OF MANUFACTURING SAME

(71) Applicant: Concrete Fiber Solutions, LLC, Buffalo Grove, IL (US)

(72) Inventor: George Garber, Lexington, KY (US)

(73) Assignee: Concrete Fiber Solutions, LLC, Buffalo Grove, IL (US)

( * ) Notice: Subject to any disclaimer, the term of this patent is extended or adjusted under 35 U.S.C. 154(b) by 280 days.

(21) Appl. No.: 18/109,354

(22) Filed: Feb. 14, 2023

(65) Prior Publication Data

US 2024/0271421 A1 Aug. 15, 2024

(51) Int. Cl.
*E04B 5/38* (2006.01)

(52) U.S. Cl.
CPC ..... *E04B 5/38* (2013.01)

(58) Field of Classification Search
CPC ..... E04C 5/166; E01C 11/18; E01C 19/50
See application file for complete search history.

(56) References Cited

U.S. PATENT DOCUMENTS

| | | | |
|---|---|---|---|
| 9,284,225 | B2 | 3/2016 | Oslejs |
| 2008/0155924 | A1 | 7/2008 | Degen et al. |
| 2018/0195280 | A1 | 7/2018 | Pratt |
| 2022/0098857 | A1* | 3/2022 | Van Vlerken ..... E04G 17/14 |

FOREIGN PATENT DOCUMENTS

| | | | |
|---|---|---|---|
| WO | WO 2012/024814 | A1 | 3/2012 |
| WO | WO 2020/248081 | A1 | 12/2020 |

OTHER PUBLICATIONS

ASTM International, Standard Specification for Concrete Aggregates, Jul. 2003, West Conshohocken, Pennsylvania.
ASTM International, Standard Specification for Portland Cement, Jun. 2007, West Conshohocken, Pennsylvania.
American Concrete Institute, Report on Chemical Admixtures for Concrete, Mar. 2016, Farmington Hills, Michigan.
ASTM International, Standard Specification for Steel Fibers in Fiber-Reinforced Concrete, Oct. 2011, West Conshohocken, Pennsylvania.

(Continued)

*Primary Examiner* — Patrick J Maestri
(74) *Attorney, Agent, or Firm* — Patzik, Frank & Samotny Ltd.

(57) ABSTRACT

A ground-supported concrete slab has a reduced concrete requirement and, in turn, a reduced carbon footprint, while still capable of supporting a desired maximum load. The slab is polygonal in shape, with at least one of its sides being at least fifty feet in length. Each side of the slab is adjacent a corresponding joint. The slab has an edge region, consisting of the portion of the slab disposed within three feet of any joint. Rebar is disposed only within the edge region of the slab. Rebar is preferably placed to form two differently sized, concentric polygons that coincide in shape with the polygonal shape of the slab. The polygons may all be square. The concrete may further include steel fibers distributed throughout the concrete. The slab is formed by providing a suitable form, placing the rebar appropriately, and filling the form with concrete to a desired thickness.

28 Claims, 4 Drawing Sheets

10
30
30
- 20 -
- 20 -
- 20 -
40
40
40

(56) References Cited

OTHER PUBLICATIONS

ASTM International, Standard Specification for Rail-Steel and Axle-Steel May 2004, West Conshohocken, Pennsylvania.
Concrete Fiber Solutions, The Edge is The Enemy, Sep. 24, 2015, Buffalo Grove, Illinois.
Concrete Fiber Solutions, You Say Your Slab is How Thick?, Nov. 6, 2015, Buffalo Grove, Illinois.
Concrete Fiber Solutions, Steel Fibers and Rebar, Dec. 9, 2015, Buffalo Grove, Illinois.

* cited by examiner

WIDE SLAB CONCRETE FLOOR WITH REDUCED CARBON FOOTPRINT AND METHOD OF MANUFACTURING SAME

BACKGROUND OF THE INVENTION

The present invention relates, in general, to ground-supported concrete floor slabs and, more particularly, to ground-supported concrete floor slabs having joint spacing of fifty feet or more. Such floor slabs are often referred to as "wide slab" or "wideslab" floors.

The edges of concrete floor slabs, proximate the joints, tend to have significant issues and concerns. Edges are less capable of carrying loads than the interior regions of a slab. Edges are where joints spall, where curling and differential movement tend to occur, and where structural failure from overloading initiates. In addition, the joints present at the edges of concrete floor slabs can require significant maintenance, requiring filling and repeated refilling. Costly load-transfer devices, such as dowels, are sometimes installed at slab edges, and these devices sometimes fail.

One manner of addressing these concerns is to manufacture wide slab, rather than conventional ground-supported concrete floors. While a conventional concrete floor may typically have joint spacing between slabs of fifteen feet or less, wide slab concrete floors may have joint spacing of fifty to one hundred twenty-five feet. Larger slabs within a given overall floor area lead to fewer joints, often 80% to 90% fewer joints, and can result in less than 10% of the surface area being within three feet of an edge. While increasing joint spacing can increase the risk of cracks developing in concrete floors, steel fibers can be added to the concrete mixture in order to control crack development.

While wide slab concrete floors reduce the number of edges, the loading of wide slab floors, particularly at the edges, continues to be a significant concern. Typically, this concern is addressed by designing the wide slab floor to have an overall thickness, given the anticipated worst-case load and multiplied by a safety factor, to provide sufficient strength where load stresses are typically at their greatest, namely the edges and corners of slabs, within three feet of an adjacent joint.

Notably, increasing the thickness of a concrete slab only proximate its edges is considered to be ineffective in addressing edge load stresses. Specifically, concrete has a tendency to shrink. Thickening slab edges restrains such shrinkage, leading to unwanted and detrimental cracks in the concrete.

Moreover, added overall slab thickness presents its own issues, particularly in view of worldwide concerns with global warming and carbon emissions. A typical Portland cement plant produces carbon dioxide emissions in two ways—from combustion and calcination. Combustion-generated carbon dioxide emissions result from the fuel consumed in cement manufacture. Calcination-generated carbon dioxide emissions result from the intense heating of raw materials, such as limestone and clay, during cement manufacture. According to the National Ready Mixed Concrete Association, 0.93 pounds of carbon dioxide is released into the atmosphere for each pound of concrete that is manufactured.

Concrete is in widespread use worldwide, with more than four billion tons being produced each year. As a result, cement and concrete is said to be responsible for approximately 8% of global carbon dioxide emissions, which is more than double that generated by aircraft or shipping. Due to the significant release of greenhouse gases during the manufacture of cement and concrete, the contribution of cement and concrete manufacture to global warming, and the carbon footprint that is associated with concrete applications, is of increasing concern.

Accordingly, it is an object of the present invention to provide concrete floors, and associated methods of manufacture, having reduced concrete requirements.

It is another object of the present invention to provide concrete floors, and associated methods of manufacture, having a reduced carbon footprint.

These and other objects and features of the present invention will become apparent in view of the present specification, drawings and claims.

BRIEF SUMMARY OF THE INVENTION

In an embodiment of the present invention, ground-supported wide slab concrete floors are produced that have a reduced thickness, and an associated reduced volume of required concrete, while still providing sufficient strength at the edges and corners of each slab to support desired loads for a particular application. This is accomplished by placing reinforcing bar, also known as rebar, about only the periphery of each slab. Specifically, rebar is placed only within an edge region, consisting of the space within two to three feet of the edges of a slab.

By doing so, the required thickness of a wide slab can be reduced by an inch or more, such as from a thickness of seven to eight inches to a thickness of six to seven inches, while still maintaining desired strength and load support properties about the edge of the slab. This can lead to a savings of 14% or more in total concrete requirements, with a similar decrease in the overall carbon footprint associated with manufacturing the concrete that is used to create the ground-supported floor. For a single one hundred foot by one hundred foot slab of a wide slab concrete floor, this can result in a savings of over eight hundred cubic feet of concrete. In a typical industrial warehouse application, this savings in concrete requirements can reduce the overall cost of the floor by $300,000 or more, based upon the current cost per cubic foot of concrete at the time of filing of the present application.

In an embodiment of the invention, at least one rectangle of rebar is placed about the two to three foot periphery, or edge region, of each wide slab. In a preferred embodiment, two concentrically positioned rectangles of rebar are so positioned. A first, outer rectangle, consisting of four lengths of rebar, is appropriately sized to be uniformly positioned six inches from the adjacent joints surrounding the slab. A second, inner rectangle, likewise consisting of four lengths of rebar, is appropriately sized to be two feet from the adjacent joints surrounding the slab. Thus, there is a spacing of approximately eighteen inches between the inner and outer rectangles of rebar. The rebar is preferably placed within the bottom third of the overall height, or thickness, of the slab.

The particular rebar, components of the concrete, and manner of preparing the concrete are all selected pursuant to the particular requirements of a given installation, with a particular emphasis on the anticipated maximum load that must be supported by the wide slab concrete floor. In a preferred embodiment of the invention, steel fibers are interspersed throughout the concrete, preferably at a concentration or density of sixty-five pounds of steel fibers per cubic yard of concrete. Moreover, each length of rebar may be a single contiguous length of material or, in view of the availability of rebar in specific common or industry-standard lengths, each length of rebar may instead consist of two or more individual lengths of rebar, placed substantially end-to-end in a collinear manner.

A method of manufacturing the present ground-supported concrete slab comprises the steps of providing a polygonal form having a plurality of sides, at least one of the sides being at least fifty feet in length, the form having an interior bounded by a plurality of inner side surfaces; placing rebar only within an edge region of the interior of the form, the edge region consisting of a portion of the interior of the form that is within three feet of at least one inner side surface of the form; and pouring concrete within the form to a desired thickness. The rebar has a plurality of sides and forms a polygonal shape corresponding to but smaller in dimension than the polygonal shape of the form. Each of the sides of the rebar is substantially equidistant from a corresponding inner side surface of the form. In one embodiment of the invention, both the form and the rebar are rectangular or square in shape.

The rebar forms a plurality of polygons. Each polygon of rebar is different in area, and the polygons of rebar are each substantially concentrically disposed within the form. The rebar extends parallel to at least one side of the interior of the form, and preferably extends parallel to each side of the interior of the form. The polygonal form may be substantially rectangular in shape, and the rebar may form a substantially rectangular shape having four sides, with each side of the rebar extending along in a spaced relationship to a corresponding inner side surface of the form. The form may be substantially square in shape, the rebar may a first square shape having four sides and a second square shape having four sides, with the second square shape being positioned inside of the first square shape. The concrete may include a plurality of steel fibers.

A ground-supported concrete floor comprises at least one contiguous slab that is polygonal in shape and has a plurality of sides, at least one of the sides being at least fifty feet in length, each of the sides being adjacent a joint. The slab has an edge region consisting of the portion of the slab disposed within three feet of a joint. The rebar disposed within only the edge region of the slab. The rebar has a plurality of sides and forms a polygonal shape corresponding to but smaller in dimension than the polygonal shape of the slab. Each of the sides of the rebar is substantially equidistant from a corresponding side of the slab. Both the slab and the rebar may be rectangular or square in shape. The rebar may form a plurality of polygons, with each polygon of rebar being different in area, and each substantially concentrically disposed within the slab.

The rebar may comprise two rectangles and the slab may be rectangular in shape. The rebar may extend parallel to at least one side of the slab, or to each side of the slab.

DETAILED DESCRIPTION OF THE INVENTION

Figure 1:
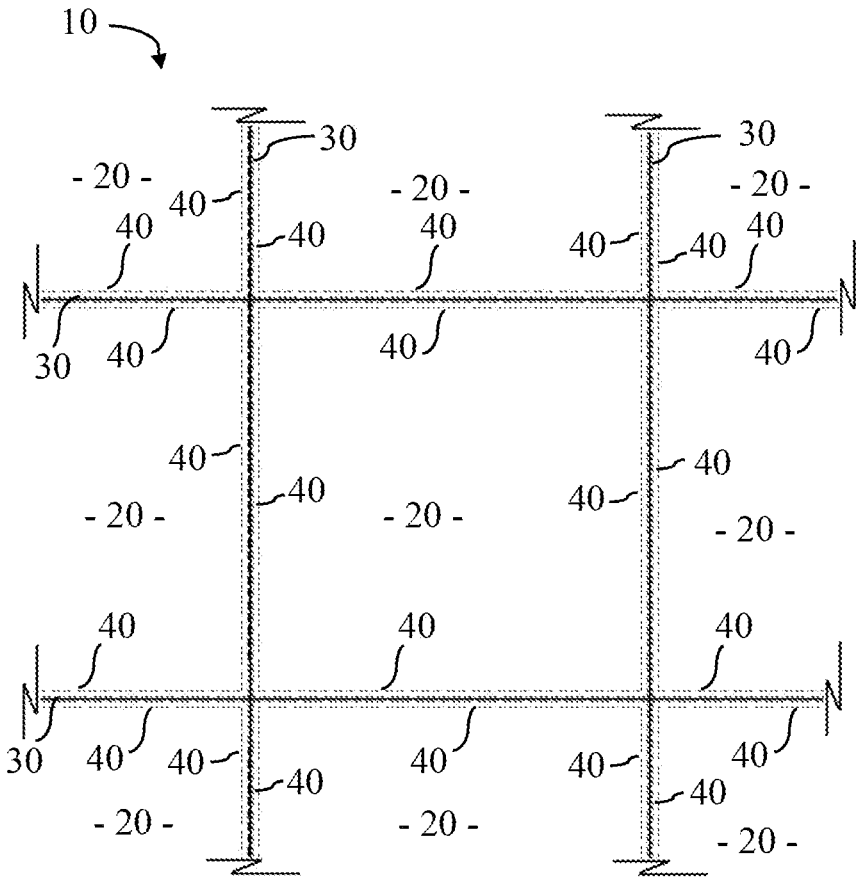
FIG. 1 is a top plan view of a portion of an embodiment of a ground-supported concrete floor having a reduced carbon footprint, showing the location of rebar in broken or phantom lines.

While the present invention is susceptible of embodiment in many different forms, there is shown in the drawings and herein described in detail, several specific embodiments, with the understanding that the present disclosure is intended to be to an exemplification of the principles of the invention and not intended to limit the invention to the embodiments illustrated.

A top plan view of a portion of an embodiment of a wide slab concrete floor having a reduced carbon footprint 10 is shown in FIG. 1 as comprising a plurality of generally symmetrically arrayed slabs 20, separated by joints 30. Joints 30 may comprise construction joints, contraction joints, expansion joints, or any combination thereof. Rebar 40 is positioned within each slab 20, proximate the edges of each slab. While, due to scale, only a single rectangle of rebar 40 is visibly shown within each slab 20 of FIG. 1, in a preferred embodiment, two relatively closely spaced, concentrically positioned rectangles of rebar 40 are preferably provided. In the example embodiment, each slab 20 has a dimension of 100 feet by 100 feet, however, slab sizes between 50 feet by 50 feet and 125 feet by 125 feet, as well as slabs that are rectangular, or that have other polygonal shapes, are also contemplated by the present invention.

Figure 2:
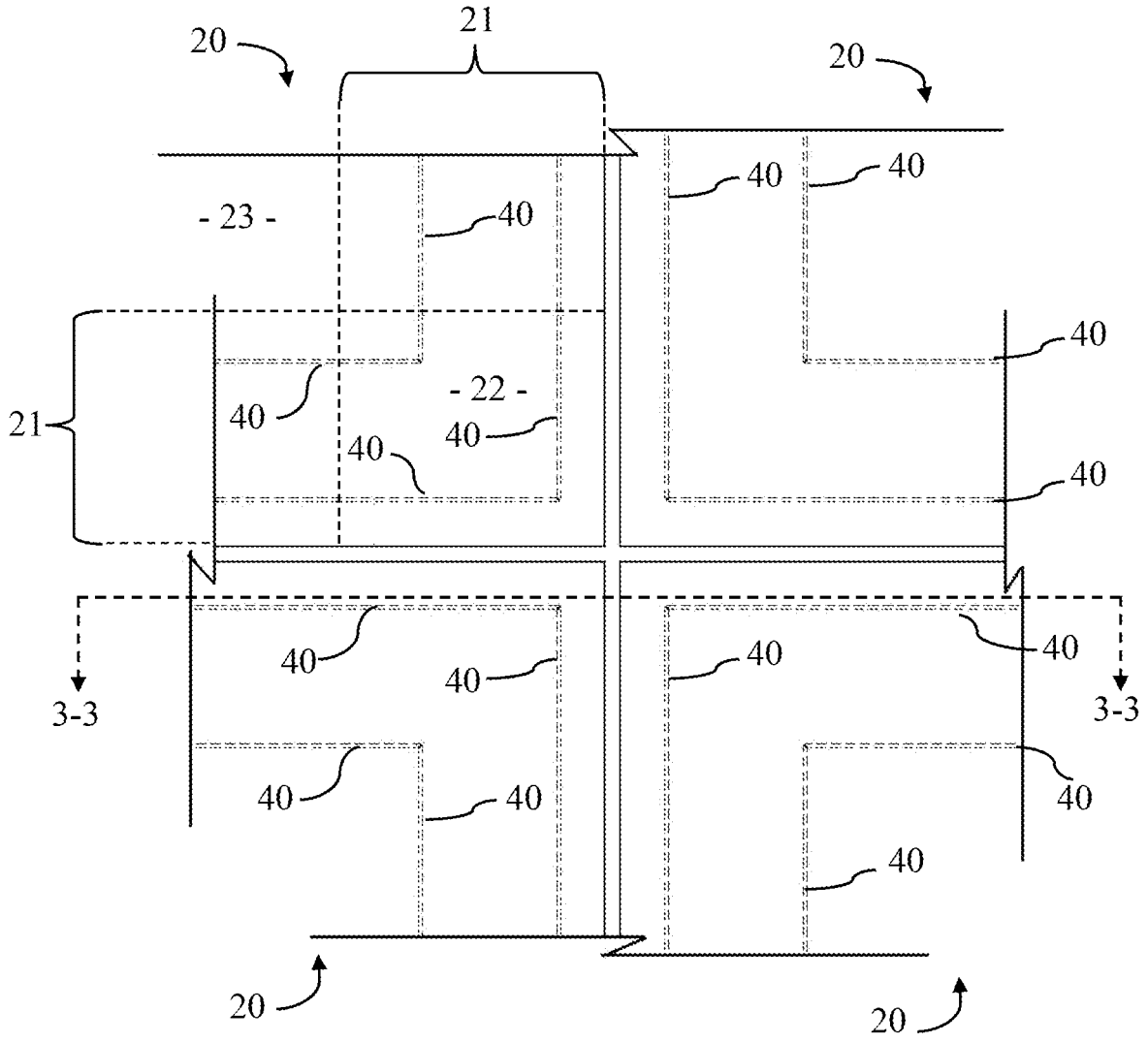
FIG. 2 is an enlarged, top plan view of a portion of the concrete floor of FIG. 1, positioned proximate the intersection of two joints and showing the location of rebar in broken or phantom lines.

As shown in FIG. 2, each slab 20 has an edge region 21, corner regions 22, and an interior region 23. Edge region 22 comprises the portion of slab 20 that is located within two to three feet of any joint 30, or any edge of a particular slab. Corner regions 22 comprise the portion of slab 20 that are located within two to three feet of an intersection of two joints 30. Interior region 23 is the portion of slab 20 that is not an edge region or a corner region, and that is spaced two to three feet, or more, from any joint or edge of the slab. Each slab 20 will typically have one rectangular edge region 21 extending about the entire periphery of the slab, four corner regions 22, with one positioned at each corner of the slab, and one large interior region 23.

Figure 3:
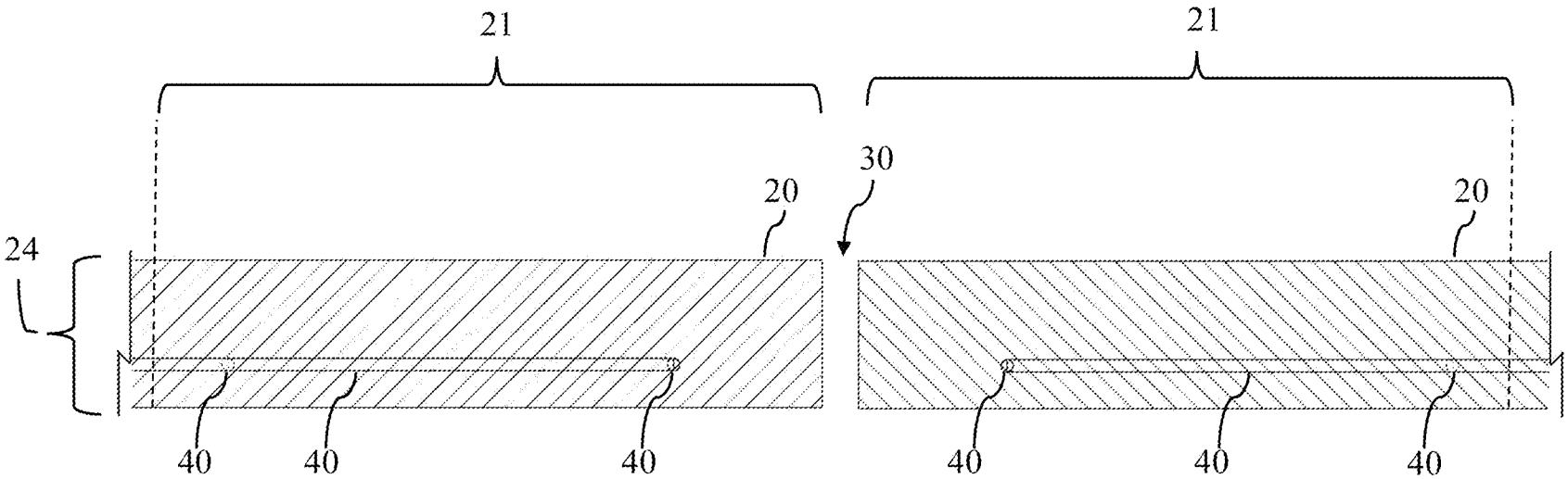
FIG. 3 is a further enlarged (relative to FIG. 2), elevated cross sectional view of a portion of the concrete floor of FIG. 1, taken generally along lines 3-3 of FIG. 2 and looking in the direction of the arrows.

As shown in FIGS. 1-3, rebar 40 is positioned within the interior of each slab 20. Importantly, rebar 40 is positioned only within edge region 21 and corner regions 22 of each slab 20, while interior region 23 of each slab is devoid of rebar. In the example embodiment, an inner rebar rectangle, consisting of four lengths of rebar 40, is spaced approximately two feet from adjacent joints 30, and an outer rebar rectangle, consisting of four additional, longer lengths of rebar 40, is spaced approximately six inches from the same adjacent joints 30. As best seen in FIG. 3, all rebar 40 is best placed below the vertical mid-plane of slab 20, and preferably within the lower third of the overall height of the slab. In the example embodiment having an overall slab thickness 24 of six inches, all rebar 40 is positioned within a region extending from one inch to one and three-quarter inches from the bottom of slab 20, with the entirely of the rebar being disposed approximately one inch or more below the mid-plane of slab 20.

Although, in the illustrated embodiment, rebar 40 is shown as comprising two concentric polygons, other configurations, also wherein rebar 40 is placed solely within edge region 21 of each slab, is also contemplated by the present invention. For example, rebar 40 that would be used to construct the inner rebar rectangle may instead be of the same length as rebar 40 of the outer rebar rectangle, but generally placed along the same longitudinal lines forming the inner rebar rectangle. In this configuration, each piece of inner rebar 40 would extend to and touch a portion of outer rebar 40. Moreover, in this configuration, the inner rebar 40 would collectively form an irregularly sized 3-by-3 grid, such as in the well-known tic-tac-toe game. More broadly, in various alternative embodiments within the scope of the present invention, each piece of inner rebar 40 may be shorter than each piece of outer rebar 40, the same length as outer rebar 40, or longer than outer rebar 40, with the only constraints on the shape and configuration of rebar 40 being that all rebar 40 be disposed solely within edge region 21 of each slab 20.

Figure 4:
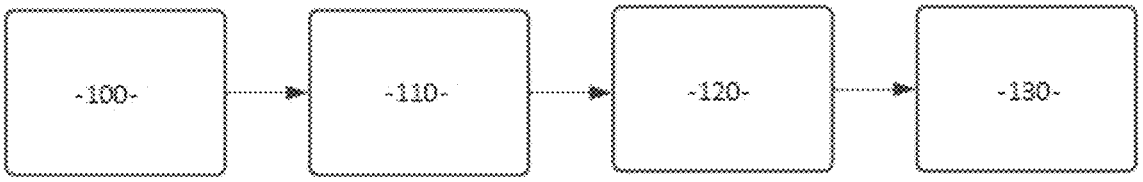
FIG. 4 is a process flow diagram of a method of manufacturing a ground supported concrete floor having a reduced carbon footprint.

A method of manufacturing or fabricating one ground-supported concrete slab, 100 foot by 100 foot by 6 inches in thickness, of an overall wide slab floor with reduced carbon footprint according to the present invention will now be described with reference to FIG. 4.

First, in step 100, an appropriate form is constructed and placed at a suitable location, upon a level and suitably prepared ground-supporting surface. In the illustrated embodiment, the form is square, with internal dimensions of one hundred feet by one hundred feet. While the preferred shape of the form is square, any polygonal form having at least one side dimension of fifty feet or more is considered to be within the scope of the present invention. The form may be constructed of wood or another suitable material. Moreover, the edges of adjacent slabs, already constructed pursuant to the present invention, may collectively serve as the form.

Next, in step 110, concrete is prepared, preferably pursuant to ASTM International's ("ASTM") C94/C94M-22a Standard Specification for Ready Mixed Concrete (last updated Sep. 1, 2022), the entirety of which is hereby incorporated by reference. The cement is preferably Type I or IL or Type II, conforming to ASTM C150/C150M-22 Standard Specification for Portland Cement (last updated Jul. 26, 2022), the entirety of which is hereby incorporated by reference. The concrete preferably includes both coarse and fine aggregate, each conforming to ASTM C33/C33M-18 Standard Specification for Concrete Aggregates (last updated Apr. 20, 2018), the entirety of which is hereby incorporated by reference. While not essential to the present invention, the concrete may optionally further include admixtures, used in accordance with American Concrete Institute's ("ACI") 212.3R/212.3R-16 Report on Admixtures for Concrete (last updated March of 2016), the entirety of which is hereby incorporated by reference. Potable mixing water is preferably used in preparing the concrete.

In step 120, once the concrete has been prepared, steel fibers conforming to ASTM A820/A820M-22 Standard Specification for Steel Fibers for Fiber-Reinforced Concrete (last updated Sep. 21, 2022), the entirety of which is hereby incorporated by reference, is preferably added to the concrete, in a concentration or density of sixty-five pounds of steel fibers per cubic yard of concrete. Although such steel reinforcing fibers are included in this example embodiment, it is also contemplated that a wide slab concrete floor may be constructed in accordance with the present invention without the inclusion of such steel fibers.

Next, in step 130, rebar is placed within the form, with suitable rebar chairs or rebar bricks being used to properly position the rebar within the form, and to uniformly elevate the rebar above the surface that will be supporting the slab. Specifically, and as shown in FIGS. 1-3, four lengths of rebar 40, each of approximately ninety-six feet in length, are positioned to construct the inner rectangle. Four additional lengths of rebar 40, each of approximately ninety-nine feet in length, are positioned to construct the outer rectangle. As rebar is generally commercially available in lengths shorter than ninety-six and ninety-nine feet, each length of rebar in the present example may consist of multiple rods of rebar, placed end-to-end in a substantially collinear manner. Each rectangle or length of rebar is uniformly spaced from the sides of the form. The outer rectangle of rebar 40 is accordingly spaced six inches from the sides of the form (and, accordingly, from the joint 30 that will be in place once the form is removed). The inner rectangle of rebar 40 is accordingly spaced two feet from the sides of the form (and, accordingly, from the joint 30 that will be in place once the form is removed).

While the rebar is preferably placed below the mid-plane of the intended thickness of the slab, and even more preferably within the bottom third of the contemplated thickness, in the present example, all of the rebar 40 is placed between one and two inches above the supporting surface, and one inch below the mid-plane of the slab that will be poured.

With all rebar 40 properly positioned and supported, concrete, prepared in the manner described above, is then poured into the form, to an even thickness of six inches.

The preceding description and drawings merely explain the invention and the invention is not limited thereto, as those of ordinary skill in the art who have the present disclosure before them will be able to make changes and variations thereto without departing from the scope of the present invention.

What is claimed is:

1. A method of manufacturing a ground-supported concrete slab, comprising the steps of:

providing a polygonal form having a plurality of sides, at least one of the plurality of sides being at least fifty feet in length, the polygonal form having an interior bounded by a plurality of inner side surfaces;

placing rebar only within an edge region of the interior of the polygonal form, the edge region consisting of a portion of the interior of the polygonal form that is within three feet of at least one inner side surface of the polygonal form and that is spaced distally from the at least one inner side surface of the polygonal form; and pouring concrete within the polygonal form to a desired thickness.

2. The method according to claim 1, wherein the rebar has a plurality of sides and forms a polygonal shape corresponding to, but smaller in dimension than, the polygonal form.

3. The method according to claim 2, wherein each of the sides of the rebar is substantially equidistant from a corresponding inner side surface of the polygonal form.

4. The method according to claim 3, wherein both the polygonal form and the rebar are rectangular in shape.

5. The method according to claim 4, wherein both the polygonal form and the rebar are square in shape.

6. The method according to claim 1, wherein the rebar forms a plurality of polygons.

7. The method according to claim 6, wherein each of the plurality of polygons of rebar is different in area, and wherein the each of the plurality of polygons of rebar is substantially concentrically disposed within the form.

8. The method according to claim 7, wherein the rebar comprises two rectangles and the polygonal form is rectangular in shape.

9. The method according to claim 1, wherein the rebar extends parallel to at least one side of the interior of the polygonal form.

10. The method according to claim 1, wherein the rebar extends parallel to each side of the interior of the polygonal form.

11. The method according to claim 1, wherein the polygonal form is substantially rectangular in shape, the rebar forms a substantially rectangular shape having four sides, each side of the rebar extending along in a spaced relationship to a corresponding inner side surface of the polygonal form.

12. The method according to claim 1, wherein the polygonal form is substantially square in shape, the rebar forms a first square shape having four sides and a second square shape having four sides, the second square shape being positioned inside of the first square shape.

13. The method according to claim 1, wherein each side of the polygonal form comprises a plurality of sides, each of the plurality of sides being at least fifty feet in length.

14. The method according to claim 1, wherein the concrete includes a plurality of steel fibers.

15. A ground-supported concrete floor comprising:

at least one contiguous slab that is polygonal in shape and has a plurality of sides, at least one of the plurality of sides being at least fifty feet in length, each of the plurality of sides being adjacent a joint;

the at least one contiguous slab having an edge region consisting of the portion of the at least one contiguous slab disposed within three feet of a joint and spaced distally from the joint; and rebar disposed within only the edge region of the at least one contiguous slab.

16. The ground-supported concrete floor according to claim 15, wherein the rebar has a plurality of sides and forms a polygonal shape corresponding to, but smaller in dimension than, the polygonal shape of the slab.

17. The ground-supported concrete floor according to claim 16, wherein each of the sides of the rebar is substantially equidistant from a corresponding side of the at least one contiguous slab.

18. The ground-supported concrete floor according to claim 17, wherein both the at least one contiguous slab and the rebar are rectangular in shape.

19. The ground-supported concrete floor according to claim 15, wherein both the at least one contiguous slab and the rebar are square in shape.

20. The ground-supported concrete floor according to claim 15, wherein the rebar forms a plurality of polygons.

21. The ground-supported concrete floor according to claim 20, wherein each polygon of rebar is different in area, and wherein the polygons of rebar are each substantially concentrically disposed within the at least one contiguous slab.

22. The ground-supported concrete floor according to claim 21, wherein the rebar comprises two rectangles and the at least one contiguous slab is rectangular in shape.

23. The ground-supported concrete floor according to claim 15, wherein the rebar extends parallel to at least one side of the at least one contiguous slab.

24. The ground-supported concrete floor according to claim 15, wherein the rebar extends parallel to each side of the at least one contiguous slab.

25. The ground-supported concrete floor according to claim 15, wherein the at least one contiguous slab is substantially rectangular in shape, the rebar forms a substantially rectangular shape having four sides, each side of the rebar extending along in a spaced relationship to a corresponding side of the at least one contiguous slab.

26. The ground-supported concrete floor according to claim 15, wherein the at least one contiguous slab is substantially square in shape, the rebar forms a substantially rectangular square shape having four sides, each of the sides of the rebar extending along in a spaced relationship to a corresponding side of the at least one contiguous slab.

27. The ground-supporting concrete floor according to claim 15, wherein each side of the at least one contiguous slab is at least fifty feet in length.

28. The ground-supported concrete floor according to claim 15, wherein the at least one contiguous slab includes a plurality of steel fibers.

* * * * *